United States Patent [19]

Romberg

[11] 4,378,657

[45] Apr. 5, 1983

[54] BUMPER ACTUATED GATE

[76] Inventor: Felix B. Romberg, P.O. Box 218, Holland, Tex. 76534

[21] Appl. No.: 214,754

[22] Filed: Dec. 9, 1980

[51] Int. Cl.[3] ..... E05C 15/00

[52] U.S. Cl. ..... 49/364; 49/30; 49/272

[58] Field of Search ..... 49/364, 272, 273, 29, 49/30, 137, 236

[56] References Cited

U.S. PATENT DOCUMENTS

| | | | |
|---|---|---|---|
| 2,076,092 | 4/1937 | Pinard | 39/31 |
| 2,594,033 | 4/1952 | Kemp | 39/40 |
| 2,691,836 | 10/1954 | David | 39/31 |
| 2,718,079 | 9/1955 | Strey | 39/22 |
| 3,049,827 | 8/1962 | Rascov | 39/31 |
| 3,378,953 | 4/1968 | Barrowclough | 49/364 |
| 3,490,175 | 1/1970 | Romberg | 49/364 |
| 3,657,842 | 4/1972 | Romberg | 49/364 |
| 3,683,554 | 8/1972 | Romberg | 49/272 |

*Primary Examiner*—Philip C. Kannan

*Attorney, Agent, or Firm*—Richards, Harris & Medlock

[57] ABSTRACT

A laterally swinging gate adapted for opening with a vehicle comprises a gate frame including stiff longitudinal members (1, 2) and upright end members (3, 4) interconnected and adapted to function as a torsion spring. The gas is pivoted at one end to a first post (16) for pivotal movement about an inclined hinge axis so that the gate is normally urged toward the closed position. At the other end of the gate a pair of second posts (71) support a bumper thrust actuated assembly (62) by which the gate is longitudinally twisted. A latch mechanism (64) releases the gate at a predetermined angle of twist so that it can swing to the open position under spring action. The gate is held in the open position for a predetermined time by a retainer mechanism (60) mounted on the first post (16).

20 Claims, 30 Drawing Figures

9
10
11
12
3
5
6
2
14
13
15
17
16
81
93
90
92
91
73
89
86
87
88

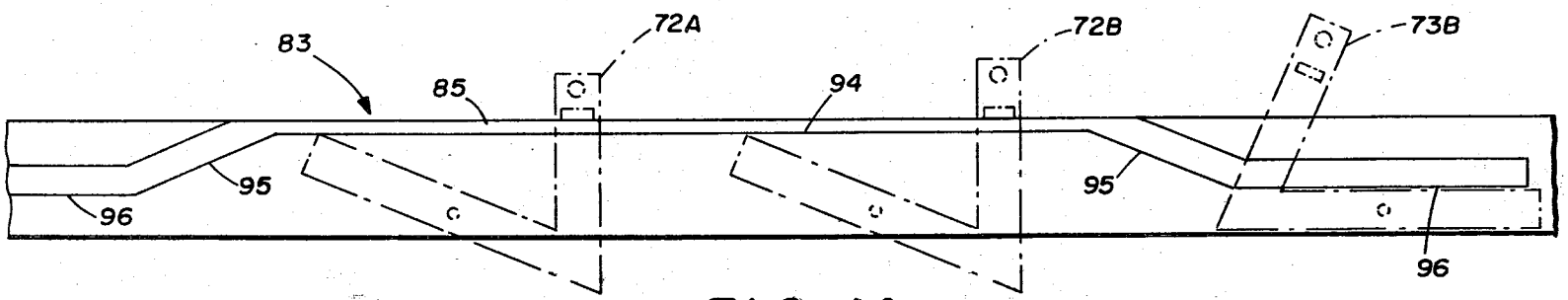
FIG. 14
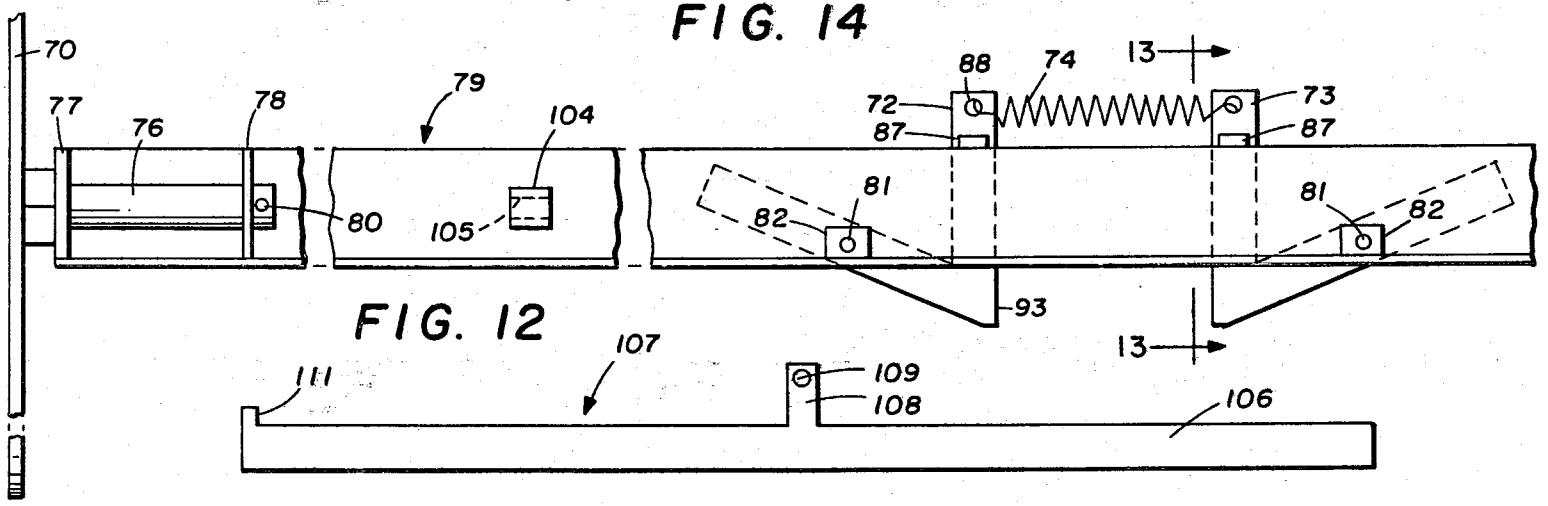
FIG. 12
FIG. 20

BUMPER ACTUATED GATE

TECHNICAL FIELD

The present invention relates generally to a laterally swinging gate, the type utilized on farms or ranches, and more particularly to a gate that automatically opens, holds open and closes, after receiving energy from a remote bumper thrust.

BACKGROUND ART

When automobiles were first produced in great volume they featured front bumpers which were deeply resilient and extended well in front of the body shell. Such bumpers were then essential on account of inadequacy in the braking system. They were also useful in pushing another car to get it started. With such bumpers, bumper gates came into limited use and were thought to be the solution to the task of opening and closing gates.

However when automobiles were given the new look after the second World War, streamlining became the vogue and front bumpers with little resilience were blended into the body shell. Further, yearly models varied the style of front bumpers, some being convoluted and others having variously designed and spaced cross bars. So now, applying bumper thrust directly to a gate is fraught with unacceptable risk of contact damage to the car and to the gate. Besides, a successful bumper operated gate must be stock-proof, economical, and workable under windy conditions. A new approach is therefore required to meet the need for a practical bumper operated gate.

SUMMARY OF INVENTION

The present invention provides a laterally swinging gate designed to work as a torsion spring and to reduce pressure from wind. There is a separate assembly at bumper height, for transmitting remote bumper thrust laterally against the openable end of the gate from either side. A latch mechanism retains the gate end in place at the top until the lateral thrust has twisted the gate to a predetermined angle, then releases the gate to spring to its open position. The gate is held in that open position for a time interval to allow vehicle passage. Thereafter, the gate closes regardless of wind direction and velocity.

DESCRIPTION OF DRAWINGS

A better understanding of the invention can be had by reference to the following Detailed Description in conjunction with the accompanying Drawings, wherein:

FIG. 12 is an enlarged fragmentary plan view of the upper angle iron of the gate actuating assembly;

FIG. 14 is an enlarged fragmentary plan view of the lower angle iron of the gate actuating assembly, with various positions of the detents relative to the camming track thereon indicated in dotted lines;

FIG. 20 is an enlarged side view of one of the spring supporting rods utilized in the gate actuating assembly;

DETAILED DESCRIPTION

The bumper actuated gate incorporating my invention is shown in FIGS. 1-30 inclusive.

Figures 2, 3, 4, 16, 17:
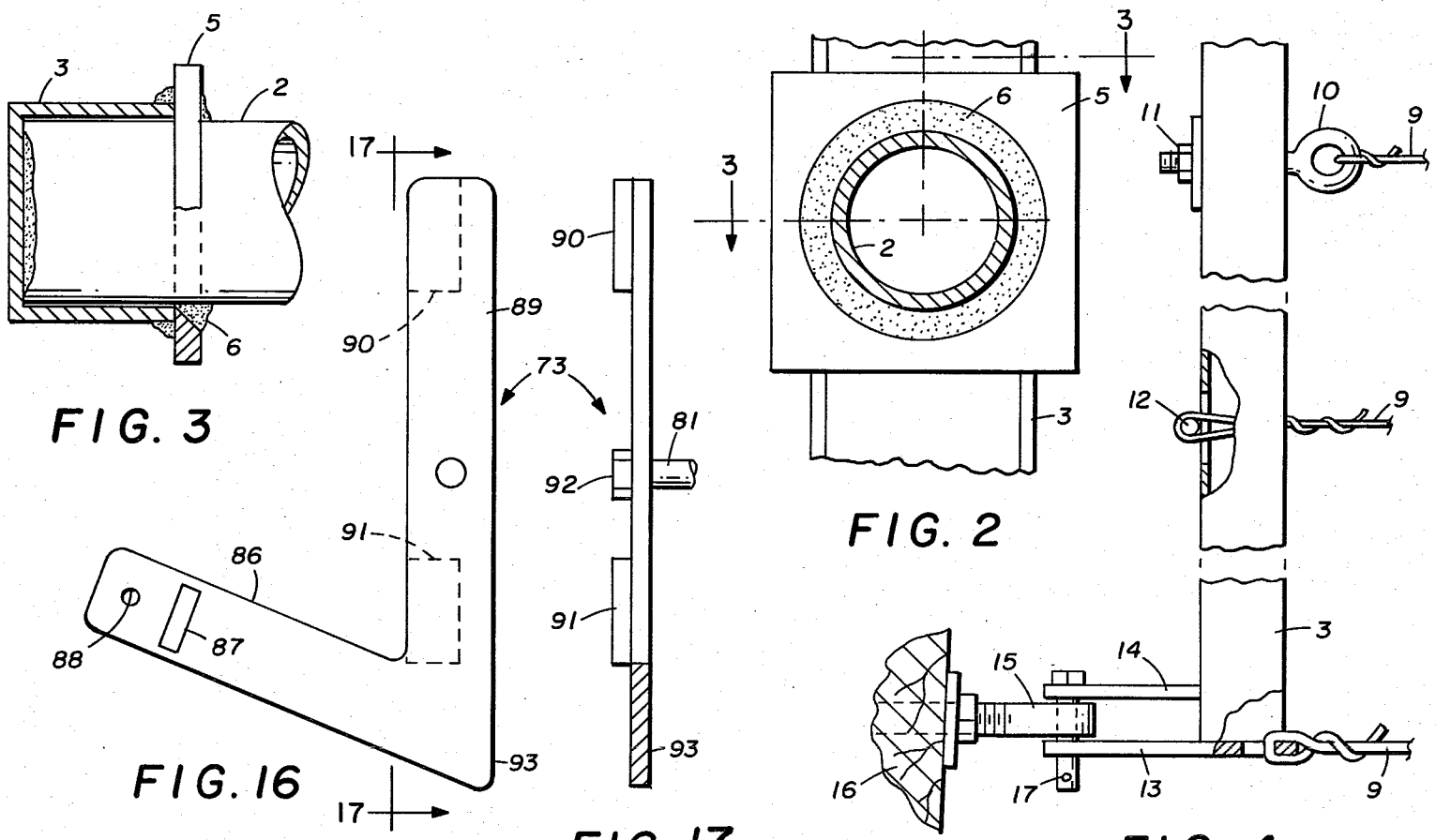
FIG. 2 is a detailed vertical cross section view taken along line 2—2 of FIG. 1.
FIG. 3 is a horizontal cross section view taken along line 3—3 of FIG. 2.
FIG. 4 is a fragmentary enlarged front view of the lower hinged corner of the gate, with certain portions cut away.
FIG. 16 is an enlarged plan view of one of the detents utilized in the gate actuating assembly.
FIG. 17 is a sectional view taken along line 17—17 of FIG. 16, with the pivot bolt added.

In the Drawings the numerals 1 and 2 (FIG. 1) refer, respectively, to upper and lower longitudinal frame members of my gate. The numerals 3 and 4 refer, respectively, to the upright frame members at the hinged end and openable end of the gate. The upright members 3 and 4 are channels of like section. The two longitudinal frame members 1 and 2 are of identical round tubular section and are welded at the ends to the web on the inner side of each upright frame member. As shown in FIGS. 2 and 3, a plate 5 with a beveled opening 6 which receives the tubular frame member 2, is welded to the open side of the upright 3 and then is welded to the tubular member 2 at the beveled opening to produce a strong joint capable of withstanding repeated torsional stresses. Similar plates 5 are located at each union of the longitudinal frame members 1 and 2 with the upright frame members 3 and 4, but the plate 7 (FIG. 5) is longer and extends upward from the frame member 1 to provide a suitable anchor for the brace 8. The rectangular gate frame defined by members 1–4 functions as a torsional spring the advantages of which will be explained more fully hereinafter.

Between the longitudinal frame members 1 and 2, the upright frame members 3 and 4 are subjected to torsion when the longitudinal frame members 1 and 2 are in torsion, but the torsional resistance of the uprights is much less because a channel is generally more flexible in torsion than a tube. Lower torsional resistance is desired in the upright frame members 3 and 4 because this generates lower bending stresses in the longitudinal frame members 1 and 2 where such bending stresses contribute less to the gate's energy storage capacity than the torsional resistance of the long tubular longitudinal frame members. In other words, more work can be had from the tubular frame members if they are relatively free from bending stresses. For purposes of illustration, the gate is shown with 2 longitudinal frame members 1 and 2; however, three or more such frame members can be utilized depending upon the torsional stiffness desired and the diameter of the tubular members.

Figures 1, 22, 23:
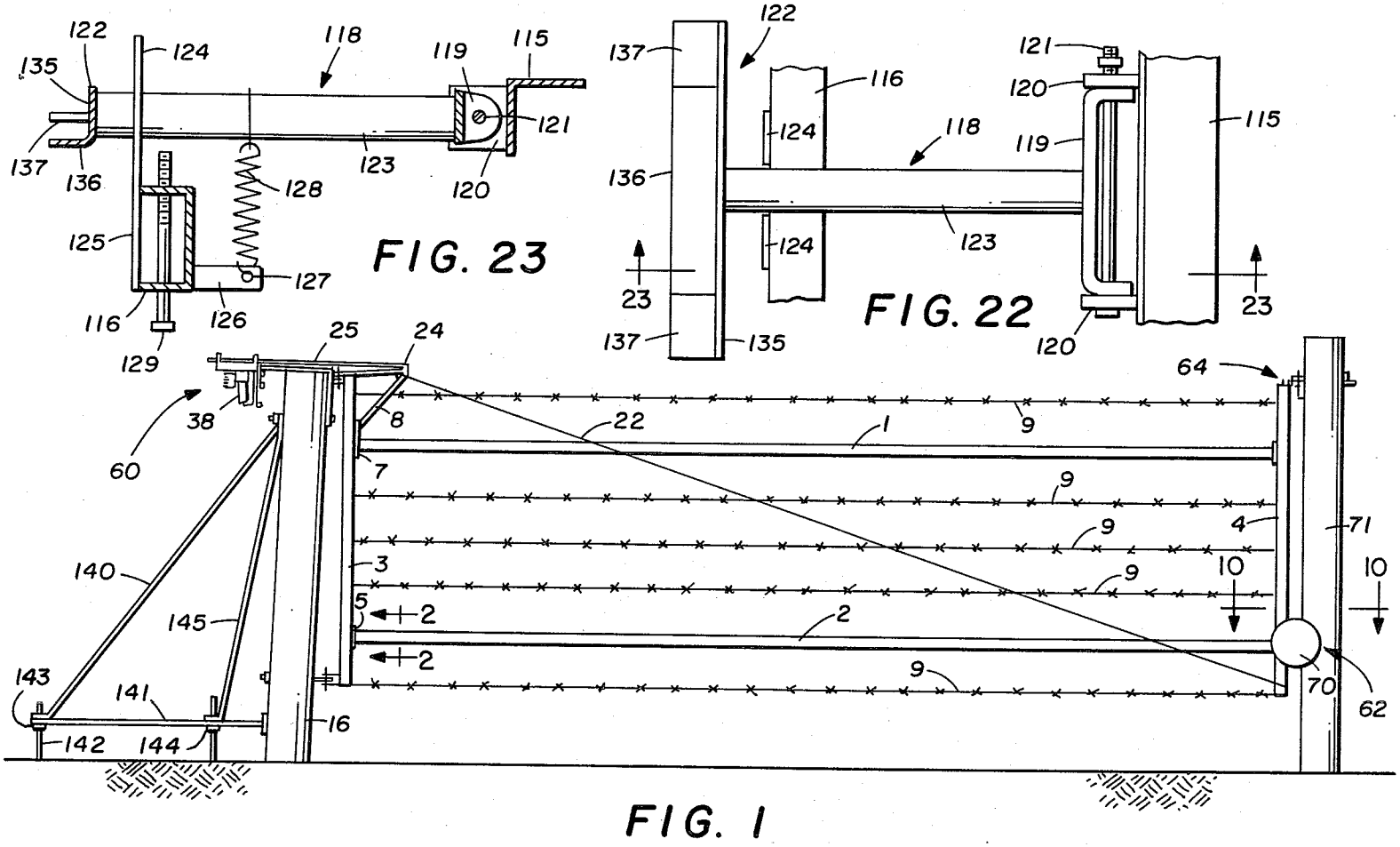
FIG. 1 is a front elevation view of my gate with its actuating and control mechanisms, the gate being shown in the closed position.
FIG. 22 is an enlarged fragmentary plan view of the latch lever and supporting parts utilized in the latch mechanism.
FIG. 23 is a section view taken along line 23—23 of FIG. 22.

Above, below and between the longitudinal frame members 1 and 2, the two upright frame members 3 and 4 are connected by barbed wires 9 (FIGS. 1 and 4). On one end each wire 9 is secured to the eye of an eyebolt 10 which passes through a perforation in the web of the adjacent upright member and through a washer to a nut 11 that can be manipulated to adjust the tension of the wire. The other end of the barbed wire 9 can be secured to the upright frame member by means of a transverse pin 12 beyond a vertical slot in the web of the frame member, for example. The bottom wire 9 may be secured at one end through a perforation in a lug 13 extending across the lower end of the upright 3 and projecting from the web of this frame member. Another lug 14 extends from the upright 3 parallel to lug 13 and is spaced therefrom to make room for the end of the anchor bolt 15 between them.

The gate is hinged at one end to a first gate post 16. The anchor bolt 15 passes through and is secured to the gate post 16. A lower hinge pin 17 passes through suitable perforations in the lugs 13 and 14 and the end portion of the anchor bolt 15. At the upper end of the upright frame member 3, the anchor bolt 18 (FIG. 5) passing through the gate post 16 extends between a lug 19 and strap 20 of the gate. An upper hinge pin 21 passes through perforations in the strap 20, bolt 18 and lug 19 for a hinged support of the gate. The hinge pins 17 and 21 are in alignment and define a hinge axis which is inclined towards the closed position of the gate so that gravity will urge the gate to its closed position. The hinge pin 17 is farther from upright 3 than the hinge pin 21 so that the hinge axis can have the proper inclination while the upright 3 is perpendicular to the longitudinal frame members 1 and 2 of the gate and those longitudinal members are substantially horizontal when the gate is in its closed position.

Figures 5, 6, 7, 8, 9:
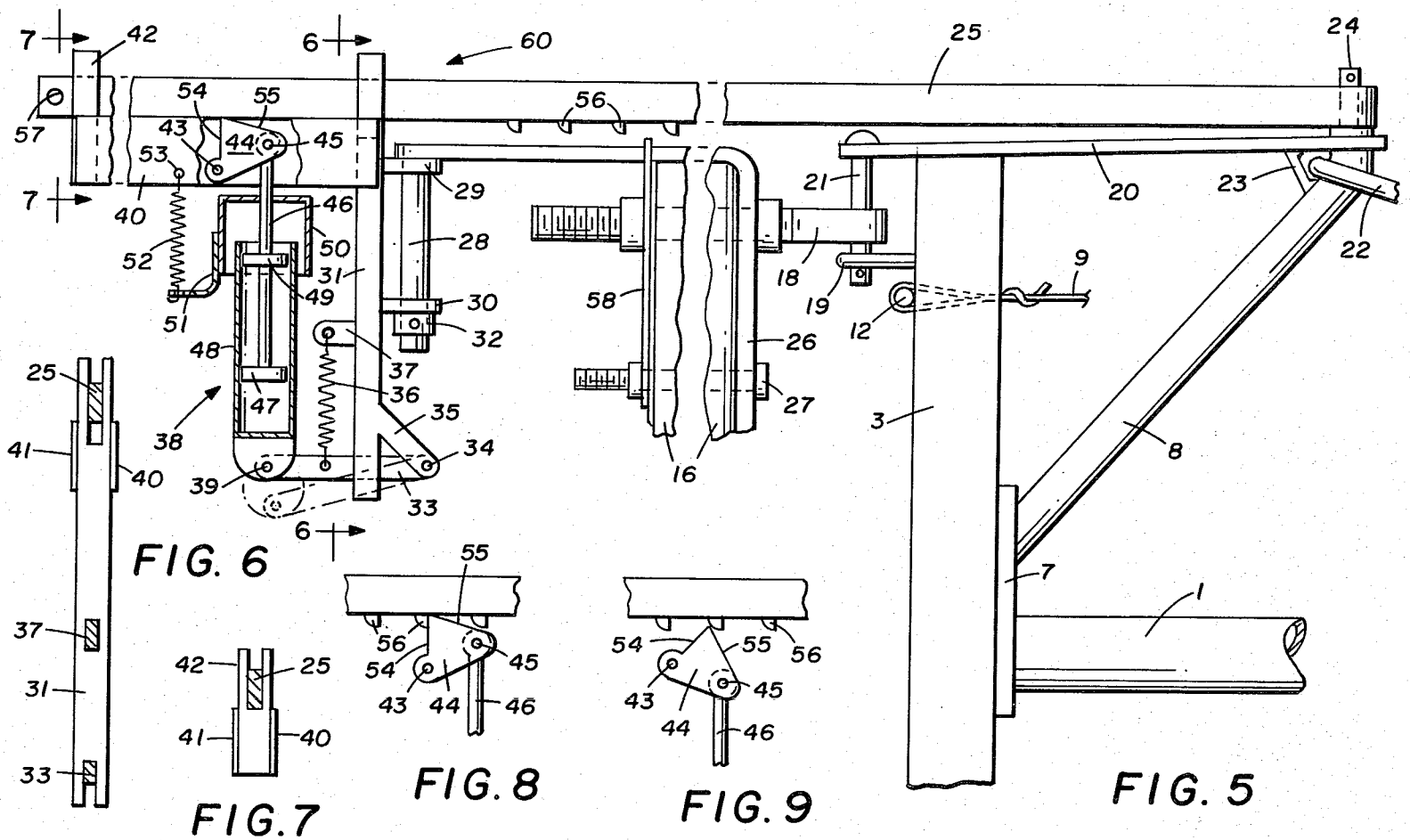
FIG. 5 is an enlarged fragmentary front view of the upper hinged corner of the gate and associated parts, with certain portions cut away.
FIG. 6 is a vertical section view taken along line 6—6 of FIG. 5.
FIG. 7 is a vertical section view taken along line 7—7 of FIG. 5.
FIGS. 8 and 9 are views illustrating operation of the mechanism which holds the gate open for a predetermined period.

Referring to FIG. 5, strap 20 extends across the top of upright 3 to a union with the upper end portion of the brace 8, in the direction of the other end of the gate. From the brace 8, a diagonal brace wire 22 extends to any suitable connection with the lower end portion of the upright frame member 4 at the openable end of the gate. Brace wire 22, which prevents the gate frame from sagging, may be held in position on the brace 8 by a cross piece 23.

A mechanism 60 for holding the gate open is connected between the gate frame and gate post 16. Extending upwardly from the junction of the brace 8 and strap 20 is a short shaft 24 to which one end of a rod 25 is pivotally attached. A flat bar 26 is secured to the gate's side of the gate post 16 by the bolt 18 and a lower bolt 27. Bar 26 is bent to extend across the top of the gate post 16 away from the gate to a dependant integral shaft 28. Pivotally mounted on shaft 28 with vertically spaced perforated lugs 29 and 30 is a vertical bar 31 which is supported vertically by a cottered collar 32 on the shaft just below lug 30. The upper end portion of the bar 31 is slotted as shown in FIG. 6 to slidably receive the rod 25. The lower portion of the bar 31 is also slotted and receives a link 33 which is pivoted at one end by a pin 34 to an arm 35 extending from the bar on the same side as the lugs 29 and 30. The link 33 is normally held against the upper end of the lower slot in bar 31 by a tension spring 36 which extends to a lug 37 projecting from the side of bar 31. Beyond the tension spring 36, the link 33 is pivotally connected with a bifurcated lower end of the dashpot 38 by a pin 39.

Integrally connected with opposite sides of bar 31 are two identical plates 40 and 41 (FIGS. 5 and 6) which extend to and are integrally secured to the sides of a short upright spacer 42 (FIGS. 5 and 7). These plates 40 and 41 and the upright members to which they are secured form a box-like structure. The upper end portion of spacer 42 is slotted as shown in FIG. 7 for slidably receiving the rod 25.

Extending between the plates 40 and 41 near the bottom thereof, a fixed pin 43 pivotally supports one corner of a detent 44 located between the plates. The detent 44 extends from that pinned corner in the direction of the bar 31 to another corner where a pivot pin 45 joins the detent with the upper end of a piston rod 46. To the piston rod 46 a lower piston 47 is secured for reciprocal movement within hydraulic fluid in the cylinder 48 of the dashpot 38. Another piston 49 is secured to the piston rod 46 in the cylinder 48 above the hydraulic fluid to align the cylinder with the piston rod. Shielding the open upper end of the dashpot cylinder 48 is a larger diameter hood 50 which is integrally connected with the piston rod 46 and surrounds the cylinder 48 with sufficient clearance to forestall bridging by water drops. From one side of the hood 50, an L-shaped bracket 51 extends downward and then horizontally outward. A tension spring 52 is stretched from a perforation at the outer end of the bracket 51 to a perforation 53 in the plate 40 above. This spring normally maintains the hood 50, or a part thereof, in contact with the plates 40 and 41. Spring 52 normally urges detent 44 counterclockwise and in contact with rod 25.

When the piston rod 46 is at its normal elevated position as shown in FIG. 5, one side 54 of the detent 44 projects upward from a point above the pivot pin 43 to a corner that contacts the bottom of the rod 25 when that rod is in its lowest position. From that corner, another side 55 of the detent 44 slants downwardly towards the corner that is pivotally connected to the piston rod 46. Detent 44 functions as a pawl to selectively engage a series of teeth 56 on the underside of the rod 25.

Referring to FIGS. 5, 8 and 9, when the gate is swung open about 100 degrees from its closed position, the shaft 24 thereon describes the curvilinear movement of a crank pin, which brings it closer to the upright bar 31 and changes its orientation relative to that bar. Accordingly, the rod 25 slides along the bar 31 and the spacer 42 and aligns these two with the moving shaft 24. The alignment is accomplished by pivotal movement about the shaft 28 of the upright bar 31 and all the structure it carries. With the sliding movement of the rod 25 above the detent 44, a tooth 56 of the series is cammed upward along the inclined side 55 of the detent and past the vertical side 54 thereof, dropping then with the rod 25 so as to be lodged behind the detent as shown in FIG. 8. Thus, when the gate has ended its opening swing, one of the teeth 56 will apply the gravitational force of the closing gate against the detent and through it to the hydraulic liquid under the piston 47.

The leakage of the hydraulic liquid past the piston 47 varies as the square root of the pressure, and hence permits the detent 44 to pivot clockwise very slowly to the position shown in FIG. 9 out of engagement with teeth 56. This releases rod 25 and permits it to move past the detent 44 and initiate closing movement of the gate under gravity. The clearance between piston 47 and cylinder 48 can be varied according to the desired flowrate of hydraulic fluid past the piston.

The spring 52 slowly returns the piston 47, piston rod 46 and detent 44 to the original postions shown in FIG. 5. The spring 36 resists ordinary forces on the dashpot 38, but in the event that a closing force much greater than the force of gravity is applied to the gate, this spring yields before any parts are overstrained, to avoid damaging the gate. Dashpot 38 is thus yieldably supported by spring 36, which comprises a significant feature of the invention.

The rod 25 is a vertically elongated rectangle in cross section to remain vertically oriented in the slots at the upper ends of the upright bar 31 and spacer 42. The rod 25 is normally held against the bottom of the slot in spacer 42 by gravity. A perforation 57 is provided at the end of rod 25 to permit the addition of weight. The spacer 42 is beyond the range of movement of teeth 56 on the rod 25, but these teeth pass back and forth through the slot in bar 31. As is best shown in FIG. 6, that slot is cut deep enough for teeth 56 to pass through freely. Any suitable shim blocks may be used to elevate the rod 25 at the slot in spacer 42 in order to shorten the interval that the gate remains held in the open position by detent 44.

As the bar 26 extends from the gate's side of the gate post 16 beyond the opposite side of the post, the distance from the gate's hinge axis to the shaft 28 can be the same regardless of the thickness of the gate post. Thus, the invention is not limited to use with a gate post 16 of a particular size. To hold the bar 26 in the extended plane of the closed gate, the holes for bolts 18 and 27 are bored in that plane and a plate 58 is secured to these bolts on the opposite side of the post 16. The plate 58 extends upward on each side of the bar 26 at the intersection with the bar 26 but not far enough upward to come into the swing path of the rod 25.

Figure 10:
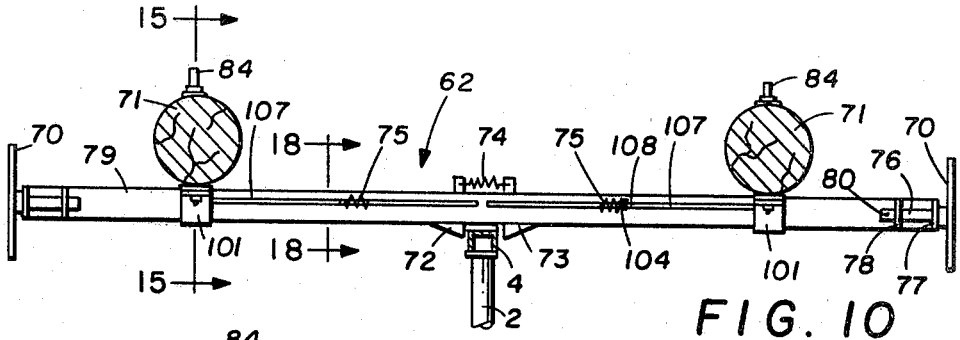
FIG. 10 is a horizontal section view taken along line 10—10 of FIG. 1 and rotated 90° counterclockwise, with certain portions cut away.

Turning now to the assembly 62 for applying remote bumper thrust to the openable end of the gate, all that can be seen of this assembly in FIG. 1 is the disk 70 for receiving the bumper thrust. FIG. 10 shows that there is another disk 70 at the opposite end of a long narrow assembly which is mounted on spaced apart second gate posts 71, and which is perpendicular to and adjacent to the closed position of the gate represented by the upright frame member 4 and the end of the longitudinal frame member 2. Pertinent details shown in FIG. 10 include the detents 72 and 73 confining the upright frame member 4 between them, a short tension spring 74 which is stretched between the detents on the opposite side of the assembly from the gate, and a long tension spring 75 which has been partially cut away to show underlying structure.

As will be explained more fully hereinafter, the disk 70 on either side of the gate can be pushed inwardly to twist the gate, thereby storing torsional spring energy therein. A latch mechanism 64 at the top of the gate retains the gate there until the gate has been twisted to a certain angle. When then released by the latch mechanism 64, the upper part of the gate accelerates towards the open position until the gate frame has reached the normal straight condition. The velocity of the upper part of the gate then decelerates as some kinetic energy is transferred to accelerate the lower part of the gate. When the velocity of the lower part of the gate has become equal to that of the upper part of the gate, some twist remains which is disipated as torsional vibration. Hence, mounting all of the bumper thrust transmitting structure on the gate posts 71 instead of on the gate, reduces both the inertial load and the energy dissipated as vibration. Leaving the longitudinal bars clean also improves their endurance as springs, provides better clearance for passing vehicles and reduces wind loads.

Figure 11:
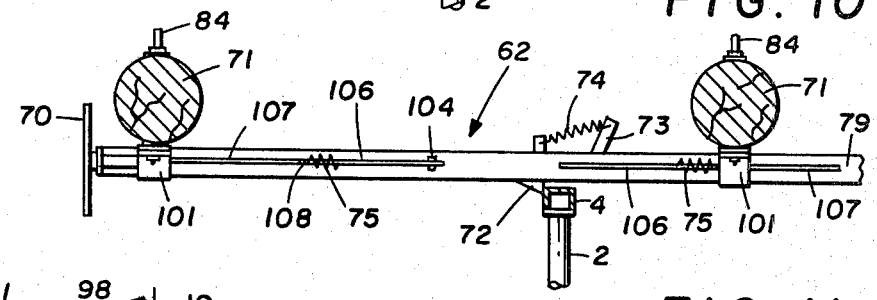
FIG. 11 is a view similar to FIG. 10 showing the parts in another position.

FIG. 11 illustrates how inward movement of the left hand disk 70 is transmitted to the upright frame member 4 of the gate by detent 72, thereby twisting the gate, while the other detent 73 is withdrawn clearing the way for the gate to spring open in that direction. FIG. 11 also shows the two springs 74 and 75 extended so that their tension can return the assembly to the position shown in FIG. 10 when the disk 70 is released from bumper pressure.

Each disk 70 is integral with a short bolt 76 (FIGS. 10 and 12) which is rotatable in perforations in cross walls 77 and 78 of the angle iron 79, and which is retained therein by a cotter pin 80. Disks 70 are thus free to rotate to prevent application of torsional force to the angle iron 79. Disks 70 are located at bumper height and are adapted to be contacted by either horizontal or vertical bumper structures, and can be faced with resilient padding if desired. The rotatable disks 70 reduce the driving skill required to operate the gate.

Figure 13:
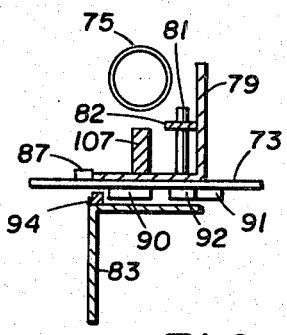
FIG. 13 is vertical section view taken along line 13—13 of FIG. 12.

The detents 72 and 73 are right hand and left hand versions of the same design. Each detent is pivotally secured to the underside of the horizontal flange of angle iron 79 by a bolt 81 that extends through a perforation therein and through a perforation in a lug 82 extending from the vertical flange of the angle iron (FIGS. 12 and 13). One of these bolts and detents is on each side of the longitudinal center of the angle iron 79. Positioned below the movable angle iron 79 is another angle iron 83 (FIG. 14), which is stationary. Angle iron 83 is held in a fixed position to each of the posts 71 by bolts 84 (FIG. 15) and has an elevated camming track 85 on the upper side of the horizontal flange, the other flange being underneath. The detents 72 and 73 are between the horizontal flanges of the two angle irons 79 and 83. The upper angle iron 79 moves longitudinally with them while the lower angle iron 83 provides the camming track which pivots the detents.

Further details of the detent 73 are shown in FIGS. 16 and 17. The fork 86 of detent 73 has a stop block 87 on its upper side. Block 87 engages the vertical edge of the upper angle iron 79 when the fork 86 is perpendicular to the angle iron. Fork 86 is normally maintained perpendicular by the spring 74, which is connected to a perforation 88 at the end of fork 86 and extends for connection in similar fashion to the detent 72 as shown in FIG. 12.

To provide vertical interlap and clearance for the camming track 85 and the fork 89 of the detent 73, these two parts must have adequate vertical thickness. For this reason, the fork 89 has a cam following block 90 on its inner under side at its end. An equally thick block 91 is on the underside near the union of fork 89 with fork 86. The head 92 of the pivot bolt 81 is also of similar thickness to blocks 90 and 91 and fits the space between the detent 73 and lower angle iron 83.

The pivot bolt 81 is located adjacent the inner side of the vertical flange of the upper angle iron 79 to leave room for the spring 75. The angle of fork 89 to the apex 93 facilitates movement of the upright frame member 4 of the gate into the space between the two detents 72 and 73. The angle of the other end of fork 89 facilitates camming of detents 72 and 73.

The camming track 85 on the upper side of the horizontal flange of the lower angle iron 83 is similar on each side of the longitudinal center of the angle iron. The middle portion 94 of track 85 is long and narrow and is adjacent to that edge of the angle iron 83 which faces away from the gate. This narrow portion 94 of the track 85 does not cam the fork 89 but serves to keep the fork 86, that passes over it, close enough to the angle iron 79 to insure proper seating of the stop block 87 on the edge of the angle iron 79.

Beyond each side of the long middle portion 94 of the camming track 85, there is a shorter diagonal portion 95 and an end portion 96 which is parallel to the side of angle iron 83. Bumper thrust moves the angle iron 79 longitudinally over the stationary lower angle iron 83 causing the block 90 of the detent 73, for example, to follow the inner edge of the camming track 85. In FIG. 14, the dotted outline 72A indicates where the detent 72 is normally positioned relative to the camming track 85. It can be moved, along with the angle iron 79, from the position 72A to 72B without encountering a diagonal portion 95 of the camming track. But with such movement of the angle iron 79, the camming block 90 of detent 73 will be negotiating a diagonal portion 95 and an end portion 96 of the camming track and will thus be cammed to the retracted position 73B.

This takes place when the angle iron 79 is moved in that direction, as indicated by FIG. 11. Should the gate end 4 apply pressure to the apical end 93 of the detent 72 from between the two detents, the pressure of the gate end against the apex will partly offset the camming force of the diagonal camming section 95. This, together with the tension of the spring 74, will offer considerable resistance but not entirely prevent the retraction of the affected detent.

Figure 15:
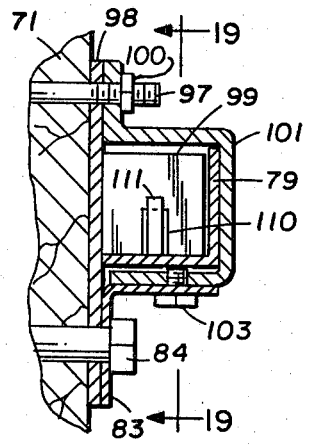
FIG. 15 is a vertical section view taken along line 15—15 of FIG. 10.
Figure 18:
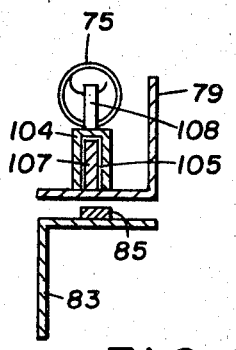
FIG. 18 is a section view taken along line 18—18 of FIG. 10.
Figure 19:
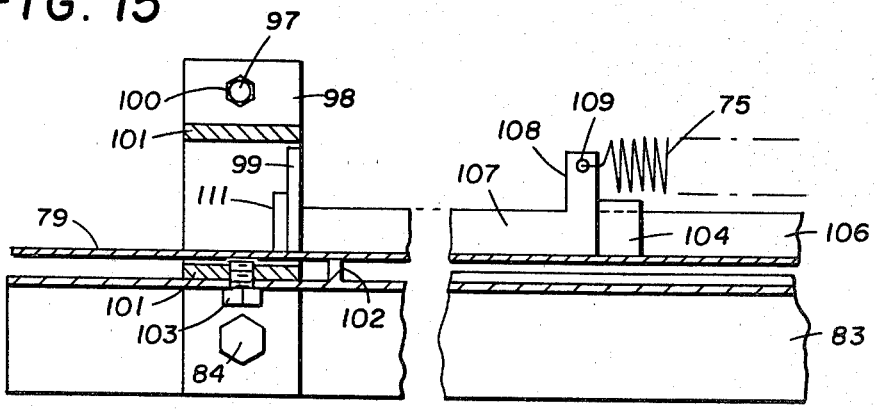
FIG. 19 is a fragmentary section view taken along line 19—19 of FIG. 15.

At each post 71, the bumper thrust transmitting assembly is supported by the lower bolt 84 and an upper bolt 97 (FIGS. 10, 15 and 19). Bolted to the post is the plate 98 which is perforated to receive the two bolts and which has an integral perpendicular vertical flange segment 99 on the side that faces toward the spring 75. Between the nut 100 of the upper bolt 97 and the plate 98 is a partly U-shaped bracket 101 which is perforated to receive the upper bolt 97. Between the head of the lower bolt 84 and the plate 98 is the vertical flange of angle iron 83.

Rising from the horizontal flange of angle iron 83 is an integral spacer 102 extending across the full width of the flange. On this spacer, the angle iron 79 rests and is longitudinally slidable. The vertical flange of angle iron 79 is slidably confined between the end of the vertical flange segment 99 and the vertical part of bracket 101. Completing the U-shaped bracket 101 is its horizontal lower portion which occupies a position between the two angle irons and is secured there by a short bolt 103 which passes through a perforation in the adjacent angle iron 83 and into a threaded perforation in the bracket 101.

On each side of the longitudinal center of the angle iron 79 and between that center and the flange segment 99, the angle iron 79 has an upstanding loop 104 (FIGS. 10, 11, 12, 18 and 19) which together with the angle iron defines a rectangular passageway 105 through which the end portion 106 of a rectangular rod 107 (FIG. 20) is slidably assembled. About midway along the length of the rod 107, there is a lug 108 which extends upwards from the edge of the rod and is perforated at 109 near its end to receive one end of the long spring 75. When the angle iron 79 is in the position shown in FIG. 10, the lug 108 is drawn against the loop 104 by the spring 75 and the rod 107 extends through a slot 110 in the flange segment 99 of the plate 98. The rod 107 is prevented from being pulled out of the flange segment 99 by a projection 111 at the end of the rod (FIGS. 19 and 20).

When the angle iron 79 is moved by bumper thrust to the position shown in FIG. 11, the loop 104 of FIG. 19 will be moved away from the lug 108 while the rod 107 and the attached end of spring 75 will remain in place as the projection 111 at the end of the rod bears against the flange segment 99 above the slot 110.

When the angle iron 79 is moved from the position shown in FIG. 10, in the opposite direction to that shown in FIG. 11, the loop 104 of FIG. 19 will push the lug 108, the attached end of the spring 75 and the entire rod 107 towards the flange segment 99. The rod 107 will then slide through the slot 110 to the extent of the angle iron's movement, just as the other rod 107 has moved in the opposite direction at the opposite end of the thrust assembly 62 in FIG. 11. When the thrust on the angle iron 79 is thereafter released, the extended spring 75 will return the rod 107 and the angle iron 79 to the positions of FIGS. 10 and 19.

The preferred embodiment of the bumper thrust assembly 62 has been illustrated and described. It will, however, be better protected from the weather if it is turned upside down and end for end so the big spring 75 and the rods 107 are on the bottom and the camming track 85 is on the underside of the angle iron 83.

Although the assembly 62 for applying remote bumper thrust to twist the gate, from either side, is somewhat effective in latching the gate against direct pressure, a special latch mechanism 64 at the upper end of the frame member 4 holds the upper gate portion and resists the force of remote bumper thrust until the gate has been twisted sufficiently in either direction to spring to an open position in that direction. This upper latch mechanism 64, which FIGS. 21–26 illustrate, unlatches the gate upon reaching a predetermined degree of twist.

Figure 21:
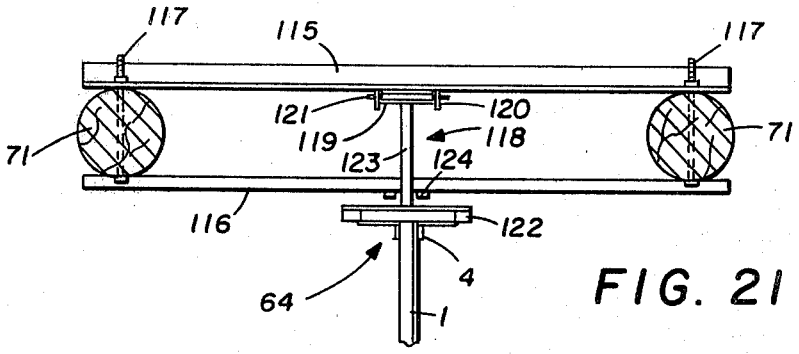
FIG. 21 is a plan view of the latch mechanism with the gate shown in the closed position.
Figure 24:
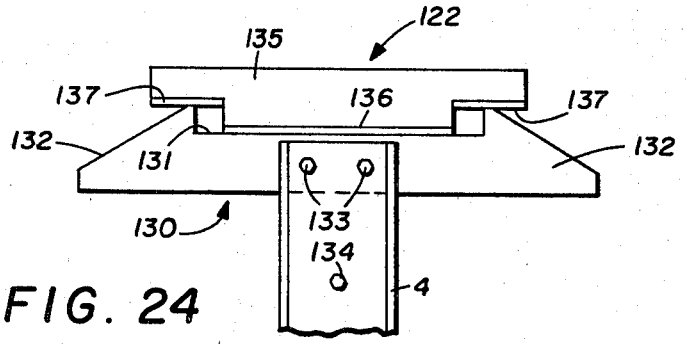
FIG. 24 is an enlarged side view of the latching head and the adjacent portion of the gate end as seen from the plane of the closed gate.

Referring to FIG. 21, opposite the upper end of the closed gate frame member 4 the two posts 71 are connected together by a horizontal angle member 115 on the back side and a horizontal channel member 116 on the gate's side. The angle member 115 is secured to the posts 71 by bolts 117. The channel member 116 is secured similarly at a lower level. Between the two posts 71 and aligned with the normal closed position of the upright gate frame member 4, is the latch lever 118.

As shown in FIGS. 21 and 22, one end of the latch lever 118 is comprised of a yoke 119 which fits closely between a pair of lugs 120 that project perpendicularly from the side of the angle member 115. The yoke 119 is hingedly connected with those lugs by a pivot bolt 121. At the other end of the latch lever is the latching head 122. The yoke 119 is united with a hollow shaft 123 which is confined but vertically movable between two forks 124 of a plate 125 which extend upward from the channel member 116.

As shown in FIG. 23, a lug 126 extends horizontally from the lower part of the channel member 116 to a perforation 127 from which a tension spring 128 extends to the shaft 123 where it may be attached in any suitable manner. Spring 128 urges latch lever 118 toward a normally downward position. Downward movement of shaft 123 may be limited with a vertically adjustable bolt 129 extending through the flanges of the channel member 116 as shown in FIG. 23.

The latch plate 130 (FIG. 24) defines a recess 131 between camming shoulders 132. This latch plate is bolted to the web of the upper end of the gate frame member 4 at 133, 133 and 134. Not shown is a strap extending from a welded connection with the main body of the latch plate 130 down to the bolt at 134.

The latching head 122 has a vertical flange 135 which is united at its longitudinal center with the end of the shaft 123 of the latch lever. The latching head 122 is a compound angle structure. Its middle portion has a horizontal flange 136 (FIGS. 22, 23, and 24) at a lower level. Its two end sections each have a higher horizontal flange 137. The difference in elevation between the two flange levels is equal to or less than the depth of the recess 131, so that each flange section 137 is in contact with the latch plate 130 above the recess when the gate is in its normal closed position.

Figure 25:
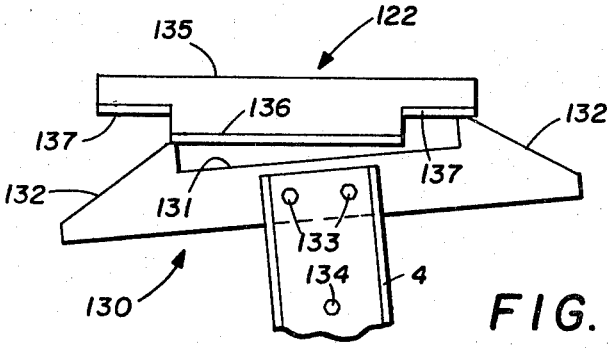
FIGS. 25 and 26 are views similar to FIG. 24 illustrating operation of the gate latch mechanism.

As is best seen in FIG. 25, when the gate is being pushed and twisted by remote bumper thrust applied via assembly 62, the top of one shoulder 132 of the latch plate bears against one of the elevated flange sections 137. At the same time, the other shoulder of the latch plate will bear the force of the lower flange section 136 at that end of the recess 131 until the flange section 136 escapes from the recess. Upon closing, latch lever 118 raises to accept plate 130 in latching engagement.

Figure 26:
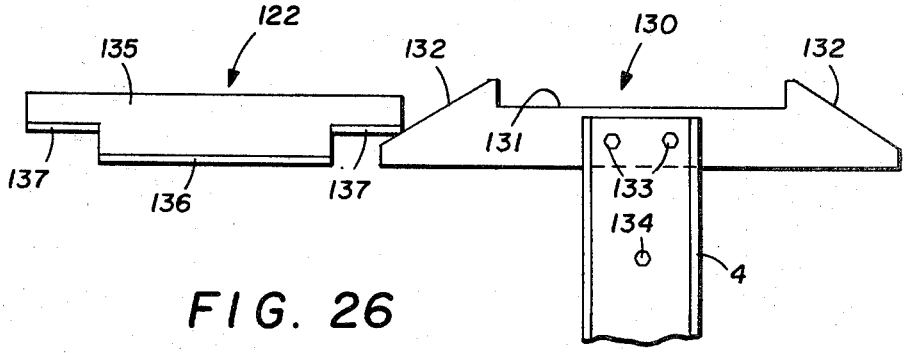

The latch mechanism 64 herein is thus an inactive device which releases the gate upon reaching a predetermined amount of gate twist. The release point depends upon the depth and width of recess 131 and corresponding flange section 136. It is desirable that the recess 131 be of substantial effective depth and also that it be longer than the flange section 136 which it must recapture. The supplemental end sections 137 of this latching head are a means for widening the reach of the latching head so the middle section 136 can be made narrower than the recess 131 and the recess can be made deeper for the same degree of twisting. The end sections 137 are also advantageous for initiating the camming of the latching head on the shoulders 132 of the latch plate, as shown in FIG. 26. Since the latch plate 130 projects on both sides of the gate where it could cause injury, it is preferably small. The present two level latching head 122 is cammable by a relatively small latch plate 130.

In accordance with the preferred construction, the gate posts 16 and 71 are each braced. The two posts 71 should be connected by a diagonal brace (not shown) to resist gate opening and closing stresses. At the hinged end of the gate, the gate post 16 is braced in two directions. One brace 140 may be in the extended plane of the closed gate. The lower end of this brace is offset from the post 16 by a strut 141 and is connected to an anchor 142 extending from the ground, for two way adjustment by vertically adjustable nuts 143 and 144. The brace 145 extending in the other direction may be similar to the brace 140.

While the first embodiment of the invention utilizes two fence post 71 at the openable end of the gate, an A-shaped or triangular metal frame like that illustrated in FIGS. 27–30 can be utilized to support the bumper thrust assembly 62 and latch mechanism 64.

Figure 27:
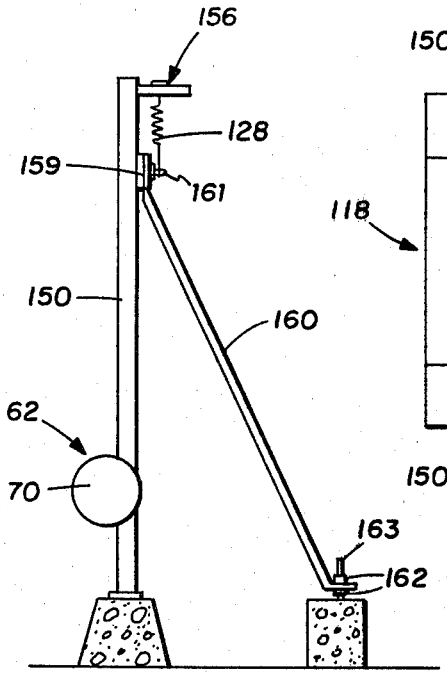
FIG. 27 is a side elevation view of an optional substitute structure for mounting the bumper thrust and latch assemblies.
Figure 28:
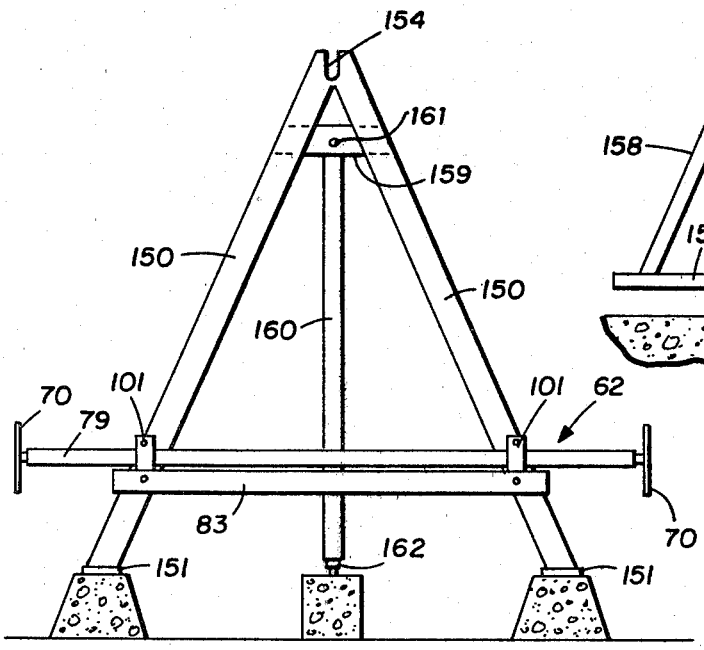
FIG. 28 is an end elevation view of the structure of FIG. 27.
Figure 29:
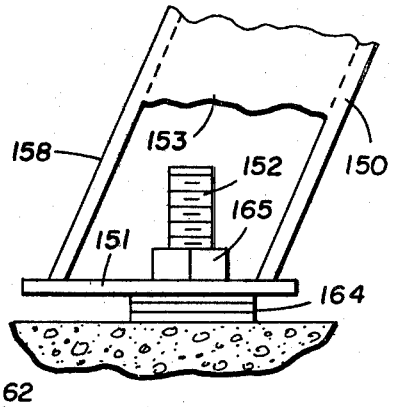
FIG. 29 is a fragmentary detailed view, with parts cut away, showing a connection with a bolt set in concrete.

FIGS. 27–30 illustrate an optional structure for mounting the bumper thrust assembly 62 and latch lever 118 in working relationship with the openable end of the gate. This optional structure is comprised of two metal channel members 150, each having an integral base plate 151 which is perforated to receive a threaded anchor bolt 152 that is set in a concrete foundation. The two channel members 150 have a web 153 facing the assembly 62 and providing a base for attaching that assembly. Together with the assembly 62, the two channel members define an A-shaped structure as shown in FIG. 28.

Figure 30:
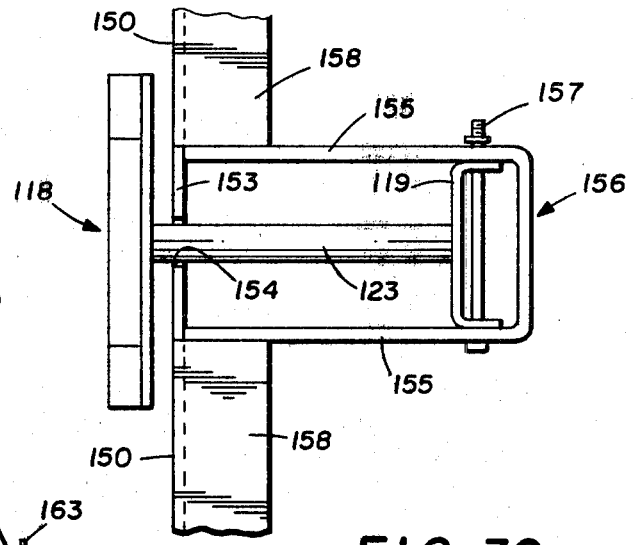
FIG. 30 is a enlarged partial plan view of the top of the structure of FIG. 27 together with the latch lever mounted thereon.

The inner flanges of the two channel members 150 terminate at their union beneath a slot 154 defined between the webs of the two channel members. The slot 154 receives and guides the shaft 123 of the latch lever 118 as shown in FIG. 30. The yoke 119 of the latch lever is pivotally mounted between two side arms 155 of a horizontal U-shaped bracket 156 by means of a bolt 157 passing through perforations in the yoke and in the arms 155. Each arm 155 of the bracket 156 is integrally joined at its end to the web 153 of one of the channel members 150 and is integrally joined to the upper end of the outer flange 158 of that channel member.

A plate 159 is integrally secured to the edges of the flanges of the two channel members below the bracket 156 as shown in FIGS. 27 and 30. To this plate 159 one end of a brace rod 160 is secured by a bolt 161 which also serves as an anchor for the spring 128 which extends to the shaft 123 of the latch lever 118. The other end of brace rod 160 is perforated and secured between nuts 162 to a bolt 163 extending from a concrete foundation as shown. By manipulating the nuts 162, the top of the A-shaped structure can be adjusted toward or away from the closed position of the end of the gate.

Although it is intended that the two ends of the gate frame be in the same plane when the gate is free from external twisting force, there may be some residual twist in the unstrained frame. To compensate for such residual twist one base plate 151 may be raised above the concrete foundation by placing washers 164 on the anchor bolt 152 below the base plate before securing the base plate with the nut 165.

The amount of energy that is absorbed by friction in the opening and closing movements of the gate is quite small. Hence, most of the energy applied to propel the gate to its open position may be returned as a closing shock at the latching head. Accordingly, the amount that the gate is lifted in its opening movement, due to the inclination of the hinge axis of the gate, should be only enough to positively propel the gate in its closing movement.

To deal with the variability of wind loads, the gate is aerodynamic in design. Moreover, the series of spaced teeth 56 on the rod 25 allows the gate to stop shorter, and hence with less lift, when opening against a strong head wind. In such a case, the reduced closing force from the lift will be compensated for by a tail wind in the closing movement of the gate. If the gate is opened with a strong tail wind, it will open wider and hence swing higher and have the extra energy stored for its closing movement against a head wind.

To protect sensitive parts of the gate against icing, they may be shielded by cover plates as desired.

A vehicle desiring to pass through the gate will first engage one of the disks 70 with its bumper to twist, release and open the gate. The vehicle must then move backward sufficiently before advancing through the gate. By the time the driver is ready to drive through, he will be able to see that the gate has been latched in its open position, allowing him ample time to drive through. Dashpot 38 can be adjusted to allow passage of trailing or secondary vehicles. Should a driver prefer to open the gate manually, he need not stop again to dismount and close the gate as the gate will close automatically behind him.

From the foregoing, it will be appreciated that the present invention offers several advantages over the prior art. The gate frame functions as a torsional spring, thereby eliminating the need for special springs and supporting structure as well as their attendant weight and bulk. The bumper thrust structure is mounted on posts 71, or on the optional channel members 150, adjacent to the openable end of the gate, rather than directly on the gate, further reducing the cross sectional area and weight of the gate and decreasing the driving skill required to use the gate. Other advantages will be evident to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, equivalents, modifications and rearrangements of elements falling within the scope of the invention as defined by the following claims.

I claim:

1. A vehicle thrust actuated gate, comprising:

a frame for a generally rectangular gate, said frame including a pair of upright end members interconnected by a plurality of stiff longitudinal intermediate members;

an upright gate post;

means mounting said gate frame at one end member thereof on said gate post for pivotal movement about an upright hinge axis between closed and open positions;

first latch means mounted on the upper end portion of the other end member of said frame;

a bumper thrust transmitting assembly for receiving and transmitting vehicle thrust laterally against the lower part of said other end member to twist said gate frame and thereby store torsional spring energy in said frame;

second latch means for retaining said first latch means when said gate frame is in its closed position and for releasing said first latch means at a predetermined angle of gate twist; and upright structure mounting said bumper thrust transmitting assembly and said second latch means in a vertically spaced operating relationship with respect to said other end member and said first latch means mounted thereon.

2. The gate of claim 1, further including:

wires tensioned between the end members of said gate frame.

3. The gate of claim 1, wherein the upright end members in said gate frame comprise channels, the longitudinal intermediate members comprise tubes, and the gate frame further includes:

plates interconnecting the tubes and channels, each plate being dimensioned for placement bridging a channel and including an opening for receiving a tube therethrough.

4. The gate of claim 1, wherein the hinge axis is inclined so that said gate frame is urged by gravity toward the closed position.

5. The gate of claim 1, further including:

means connected between said gate frame and said post for holding said gate frame in the open position for a predetermined time interval.

6. The gate according to claim 1, wherein said bumper thrust transmitting assembly is elongated, is supported on said upright structure on each side of the closed position of said gate frame and terminates at each end with a vehicle receiving target.

7. The gate according to claim 6, wherein the bumper thrust transmitting assembly comprises first and second adjacent parallel bars, the first bar being secured along each of its ends to said upright structure;

the second bar terminating at its ends with said bumper receiving targets and being slidable longitudinally between extended and retracted positions;

a pair of detents pivoted to said second bar and adapted to receive said other end member of said gate frame therebetween, said detents being pivotal between extended and retracted positions;

means for normally urging both of said detents towards extended positions; and means associated with said bars for retracting the detent located forward of said gate frame upon movement of said second bar toward that detent's retracted position.

8. The gate according to claim 7, further including:

spring means for returning said second bar to a normal longitudinally centered position when released from external vehicle pressure.

9. The gate according to claim 7, wherein each bumper receiving target is a disk integral with a shaft that is mounted longitudinally and rotatably at the end of said second bar.

10. The gate according to claim 1, wherein one of said latch members defines a recess and a camming shoulder on each side of said recess, and the other latch member comprises a latch lever pivoted at the mounted end and terminating at the free opposite end with a latching head;

said latching head comprising a generally horizontal lower central portion cammable on said shoulders and receivable in said recess, and a vertically offset cammable portion adjacent to and beyond each end of said lower central portion;

the length of said lower central portion plus either offset end portion being greater than the length of said recess, and the vertical offset distance at each end of said lower central portion being not greater than the depth of the corresponding end of said recess.

11. A gate adapted for mounting between first and second upright structures, comprising in combination:

a gate frame including a pair of upright channel-shaped end members, a plurality of mutually spaced apart longitudinal tube frame members connected between the end members, and wires connected between the end members;

said gate frame being adapted to function as a torsional spring;

means for connecting said gate frame at one end member thereof to the first upright structure for pivotal movement between open and closed positions about an upright hinge axis, the hinge axis being inclined toward the second structure so that said gate frame is gravitationally urged toward the closed position;

means mounted on the second upright structure for engaging and longitudinally twisting said gate frame at the other end member thereof to store torsional spring energy in said gate frame; and means mounted on the second structure in vertically spaced relationship with said twisting means for normally latching said gate frame at the other end member thereof in the closed position and then releasing said gate frame upon reaching a predetermined amount of twist so that said gate frame swings under spring action to the open position.

12. The gate of claim 11, further including:

means connected between said gate frame and first post for holding said gate frame in the opened position for a predetermined time interval.

13. The gate according to claim 12, wherein said holding means comprises:

a rod pinned at one end to said gate frame inward of the hinge axis thereof;

structure mounted on said first post for receiving and slidably guiding the other end of said rod during pivotal movement of said gate frame;

a plurality of teeth mounted in longitudinally spaced relationship on said rod;

a detent pivoted to said structure for movement into and out of engagement with said teeth;

dashpot means coupled to said detent for yieldably urging said detent into engagement with said teeth for a predetermined time during which said gate frame is held open by said rod, after which said detent releases said rod allowing said gate frame to close under the action of gravity; and means for resiliently supporting said dashpot means on said structure.

14. The gate of claim 11, wherein said twisting means comprises:

a first bar secured to the second post and extending transverse to said gate frame in a direction toward the opened position;

a second bar adjacent to said first bar mounted for sliding movement between extended and retracted positions;

means for urging said second bar toward the extended position;

a pair of detents pivoted to said second bar and adapted to receive the other end member of said gate frame therebetween, said detents being pivotal between extended and retracted positions;

means for normally urging both of said detents toward extended positions;

means associated with said bars for retracting the detent located forward of said gate frame upon movement of said second bar toward the retracted position; and a rotatable contact plate secured to said second bar and adapted for engagement with a vehicle.

15. A gate assembly, which comprises:

a first upright gate post;

a pair of spaced apart second gate posts mounted in spaced relationship with said first gate post;

a generally rectangular gate extending between said first and second gate posts;

said gate including a gate frame comprised of a pair of stiff upright end members interconnected by a plurality of mutually spaced apart stiff longitudinal members, the gate frame being adapted to function as a torsion spring;

means for connecting said gate at one end to said first post for pivotal movement about a hinge axis between open and closed positions, the hinge axis being inclined toward said second gate posts so that said gate is gravitationally urged toward the closed position;

means mounted on said second gate posts for engaging and longitudinally twisting said gate at the other end thereof to store torsional spring energy in said plate;

means mounted on said second gate posts in vertically spaced relationship with said twisting means for normally latching said gate in the closed position and then releasing said gate at a predetermined angle of gate twist so that said gate swings to the open position under spring energy; and means connected between said gate and first gate post for releasably retaining said gate in the open position for a predetermined time interval before allowing said gate to close under the action of gravity.

16. The gate assembly of claim 15, further including:

wires stretching between the end members of the gate frame of said gate.

17. The gate of claim 15, wherein said twisting means comprises:

a first bar secured to said second posts and extending transverse to said gate frame in a direction toward the open position;

a second bar adjacent to said first bar mounted for sliding movement between extended and retracted positions;

a pair of detents pivoted to said second bar and adapted to receive the adjacent end member of said gate frame therebetween, said detents being pivotal between extended and retracted positions;

means for normally urging both of said detents toward extended positions;

means associated with said bars for retracting the detent located forward of said gate frame upon movement of said second bar toward the retracted position; and vehicle contact structure secured to said second bar for actuating said twisting means.

18. The gate according to claim 15, wherein said retaining means comprises:

a rod pinned at one end to said gate frame inward of the hinge axis thereof;

means mounted on said first post for receiving and slidably guiding the other end of said rod during pivotal movement of said gate frame;

a plurality of teeth mounted in longitudinally spaced relationship on said rod;

a detent pivoted to said structure for movement into and out of engagement with said teeth;

dashpot means coupled to said detent for yieldably urging said detent into engagement with said teeth for a predetermined time during which said gate frame is held open by said rod, after which said detent releases said rod allowing said gate frame to close under the action of gravity; and means for resiliently supporting said dashpot means on said structure.

19. A vehicle thrust operated gate hingedly supported by a gate post at one end along a first upright pivot axis for laterally swinging movements between open and closed positions, further having:

means for urging said gate from the open position to the closed position, means for latching said gate in the open position for a predetermined time interval and for then releasing it for movement to its closed position;

said latching and releasing means comprising pivoted structure connected with said gate post at a second pivot axis;

said second pivot axis being parallel with said first pivot axis and being opposite the closed position of said gate from said first pivot axis;

a rod pinned to said gate inward of said first pivot axis;

said pivoted structure of the latching and releasing means defining a pair of spaced apart slots for slidably containing said rod and for aligning said pivoted structure with said rod;

a series of teeth longitudinally spaced on said rod and defining a path of back and forth movement at the lower side of said rod;

said rod and said teeth moving inward relative to said pivoted structure of the latching and releasing means during the opening movement of said gate and moving in the reverse direction during the closing movement of said gate;

a detent pivoted to said pivoted structure of the latching and releasing means for movement into and out of the path of movement of said teeth;

said detent and said teeth normally defining a slanting slidable contact when the teeth engage said detent in their inward movement and defining an interlocking contact when said teeth engage said detent in the reverse movement;

dashpot means coupled to said detent for yieldably urging said detent into engagement with said teeth for a predetermined time during which said gate is held open by said rod, after which said detent releases said rod allowing said urging means to close the gate; and means for resiliently supporting said dashpot means on said pivoted structure of the latching and releasing means.

20. A vehicle thrust actuated gate, comprising:

a frame for a generally rectangular gate, said frame including a pair of upright end members interconnected by a plurality of stiff longitudinal intermediate members;

an upright gate post;

means mounting said gate frame at one end member thereof on said gate post for pivotal movement about an upright hinge axis between closed and open positions;

a first latch member mounted on the upper end portion of the other end member of said frame;

a bumper thrust transmitting assembly extending from a remote bumper engagable terminal thereof and being engagable laterally against the lower end portion of said other end member while the gate is in its normal closed position, thereby to twist said gate frame to store torsional spring energy therein;

upright structure mounting said bumper thrust transmitting assembly adjacent to and in operating relationship with the gate in its normal closed position; and a second latch member mounted on said upright structure in operating relationship with said first latch member and disengagable from said first latch member when said other end member is twisted to a predetermined angle.

* * * * *

UNITED STATES PATENT AND TRADEMARK OFFICE

CERTIFICATE OF CORRECTION

PATENT NO. : 4,378,657

DATED : April 5, 1983

INVENTOR(S) : Felix B. Romberg

It is certified that error appears in the above-identified patent and that said Letters Patent are hereby corrected as shown below:

On The Title Page:

Line 5 of Abstract, change "gas" to --gate--.

Column 14, line 31, change "plate" to --gate--.

Signed and Sealed this

Eleventh Day of October 1983

[SEAL]

*Attest:*

GERALD J. MOSSINGHOFF

*Attesting Officer* *Commissioner of Patents and Trademarks*